United States Patent [19]
Ohba et al.
[11] 4,402,410
[45] Sep. 6, 1983

[54] SHEET SORTING APPARATUS

[75] Inventors: Hiroshi Ohba; Shigeo Horino, both of Tokyo, Japan

[73] Assignee: Tokyo Shibaura Denki Kabushiki Kaisha, Kawasaki, Japan

[21] Appl. No.: 189,220

[22] Filed: Sep. 22, 1980

[30] Foreign Application Priority Data

Sep. 25, 1979 [JP] Japan ..... 54-122065

[51] Int. Cl.[3] ..... B07C 5/10
[52] U.S. Cl. ..... 209/534; 493/16
[58] Field of Search ..... 209/534; 194/4, DIG. 26; 93/98 R, 93 M, 93 D

[56] References Cited

U.S. PATENT DOCUMENTS 3,759,382 9/1973 Walkley et al. .
3,976,198 8/1976 Carnes et al. ..... 209/534
4,025,420 5/1977 Horino ..... 209/534
4,236,639 12/1980 Boettge et al. ..... 209/534

FOREIGN PATENT DOCUMENTS 1510206 5/1978 United Kingdom .

*Primary Examiner*—David A. Scherbel
*Attorney, Agent, or Firm*—Cushman, Darby & Cushman

[57] ABSTRACT

Apparatus for sorting sheets from a stack. A take-out device is provided for drawing sheets from the stack one at a time. These sheets are transferred to an inspecting station which classifies the sheets and sorts them into reusable sheets and unreusable sheets. The reusable sheets are bundled. The unreusable sheets are first collected until the entire stack of sheets has been processed. Only then are the collected unreusable sheets automatically invalidated.

6 Claims, 20 Drawing Figures

FIG. 3

| | BATCH NUMBER | OPERATION RESULT (Q, Qn, Qn+1) |
|---|---|---|
| 1 | | |
| 2 | | |
| | | |
| n-1 | | |
| n | | |
| n+1 | BATCH NUMBER | |
| n+2 | THE NUMBER OF THE REJECTIVE NOTES | |
| n+3 | THE REAPPLIED NUMBER OF THE REJECTIVE NOTES | |
| n+4 | THE TOTAL SUM OF THE REJECTIVE NOTES | |
| n+5 | THE NUMBER OF THE UNFIT NOTES | |
| n+6 | THE REAPPLIED NUMBER OF THE UNFIT NOTES | |
| n+7 | THE TOTAL SUM OF THE UNFIT NOTES | |
| n+8 | THE TOTAL SUM OF THE DAMAGED NOTES | |
| n+9 | THE TOTAL SUM OF THE NORMAL NOTES | |

SHEET SORTING APPARATUS

BACKGROUND OF THE INVENTION

The present invention relates to a sheet sorting apparatus which automatically inspects sheets such as, for example, securities, slips, stock certificates, and checks (referred to as notes or sheets), and sorts the sheets into reusable notes, unreusable notes and unidentifiable notes.

Recently, various sheet sorting devices of the just-mentioned type have been developed and put into a practical use. The sorting device automatically counts the notes sheet by sheet to check the number of the notes being handled while at the same time detects the unidentifiable notes such as notes where are erroneously taken two at a time, false notes, and foreign notes. These notes are rejected. The sorting apparatus further sorts the notes into reusable notes (referred to as normal notes) and unreusable notes (referred to as worn-out notes), and stacks those notes into 100-note stacks (each referred to as a unit note stack or merely a stack), bundles and stamps those unit note stacks.

Generally, the worn-out notes are destroyed by burning or chemical melting. Actually, as in the case of the normal notes, the worn-out notes must be stored under a strictly supervised condition until those are destroyed. At the same time, it is necessary to invalidate the sorted worn-out notes. "Invalidate the notes" means to invalidate a value of the notes.

SUMMARY OF THE INVENTION

Accordingly, an object of the invention is to provide a sheet sorting apparatus which, itself, invalidates the notes sorted as being worn-out to make easy the subsequent handling of the worn-out sheets.

To achieve the above object of the invention, sheets are taken out one at a time from a group having a predetermined number of stacked sheets. The sheets are then conveyed to a detector for inspecting and sorting the sheets into reusable sheets and unreusable sheets. After sorting, the reusable notes and the unreusable notes are separately collected until the entire group of sheets have been processed. Only then are the unreusable sheets invalidated.

Other objects and features of the invention will be apparent from the following description taken in connection with the accompanying drawings, in which:

BRIEF DESCRIPTION OF THE DRAWINGS

FIG. 3 is a memory map of a memory used in the sorting apparatus shown in FIG. 2;

DETAILED DESCRIPTION OF THE PREFERRED EMBODIMENTS

Figure 1:
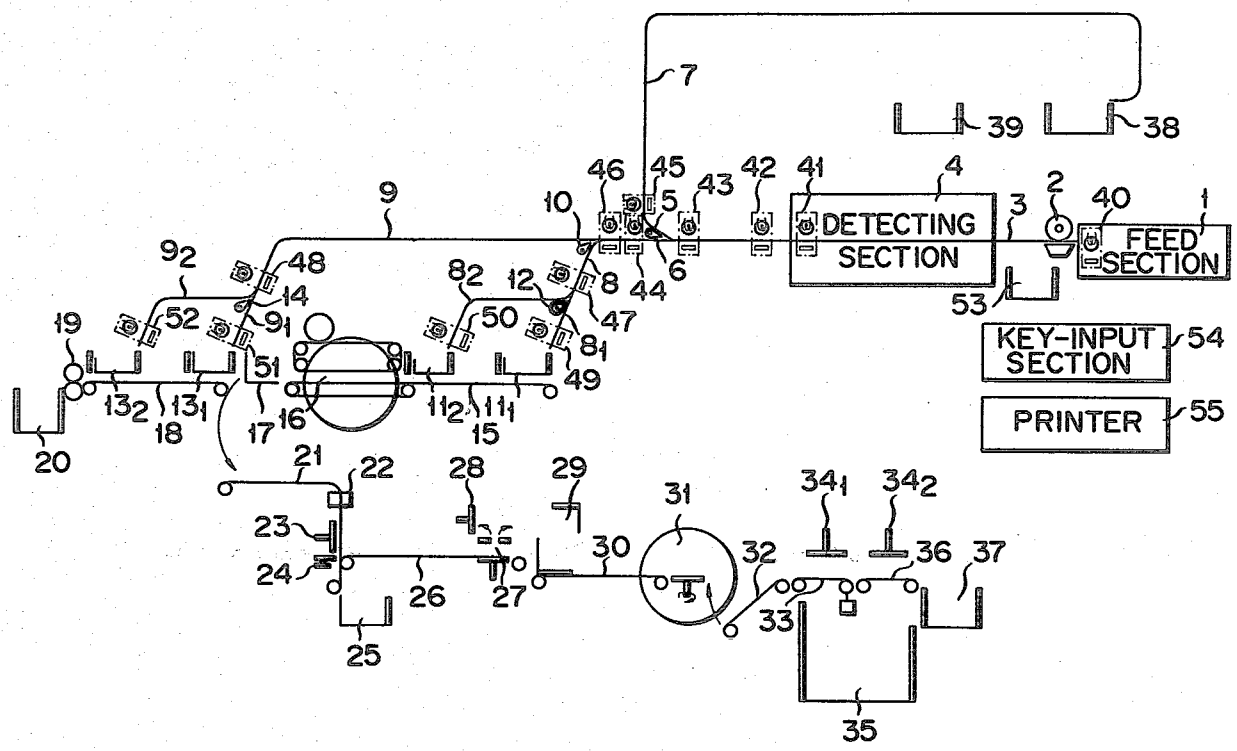
FIG. 1 shows a schematic diagram of an overall of a sheet sorting apparatus according to an embodiment of the present invention.

Referring now to FIG. 1, a sheet supply section 1 has stacks of sheets such as securities each including 100 sheets or notes, for example, set in an upstanding state. When the sorting operation starts, the supply section supplies the notes to a take-out device 2 which is comprised of a suction rotor, for example. The take-out device 2 successively takes notes from the sheet supply section 1 sheet by sheet at given intervals and deposits them on a transfer or conveying means 3 which may be made of a pair of conveyor belts to firmly hold the notes. The transfer means 3 transfers the notes to a detecting section 4 and a sorting section 5. The detecting section 4 is provided in the midportion of the conveying means 3, and functions as follows.

The first function is to accurately count the number of the incoming notes and to verify that the actual number of the notes corresponds to the number of notes assumed to be in the stack.

A second function is to detect whether or not more than one note has been taken out at a time. When two more sheets are taken out at one time, that is, the notes are taken out in a superposed manner, it is impossible to accurately detect and count the notes. The detector for this function may be an optical means in which a change of the light transmitted through the notes is detected or a mechanical means which mechanically detects the thickness of the notes.

The third function is to detect when adjacent notes taken out by the take-out device 2 are too close. When adjacent notes are taken out too close, it is impossible to accurately detect and count the notes. For detecting this problem, a detector detects the interval between adjacent notes and compares the interval with a normal value.

The fourth function is to separate unidentifiable notes (foreign notes, false notes, invalid notes and other related notes) and worn-out notes unfit for reuse. A detector for this function may be a known optical or mechanical detecting means. An optical character reader may further be used. In this case, the character reader reads the given information on the notes such as serial numbers to sort the older notes. Thus, the detecting means may be constructed by a set or sets of detectors. In this case, the detecting means normally classifies the notes as either unidentifiable (including false notes, foreign notes, worn-out notes and those other than the worn-out notes and the normal notes), worn-out, i.e., unsuitable for recirculation and normal, i.e., qualified for recirculation. On the basis of the classification, each note is judged in accordance with the priority order as given below.

| Order | Final Decision | Reason |
|---|---|---|
| 1st | Invalid | Any of the members of the detecting device decides the note to be invalid. |
| 2nd | Worn-out | Though none of the members of the detecting device decides the note to be invalid at least |

-continued

| Order | Final Decision | Reason |
|---|---|---|
| 3rd | Normal | one member thereof judges the note to be undesirably worn-out. None of the members of the detecting device decides the note to be invalid or worn-out, but all the members thereof judge the note to be normal. |

The sorting device 5, provided at the terminal portion of the conveying means 3, directs the notes to a first or second conveying path 6 or 7 in accordance with a judging result signal derived from the detecting device 4. When the detecting device 4 judges the notes to be unidentifiable, the corresponding note is led to the second transfer path 7. When it judges the note to be worn-out or normal, the corresponding note is led to the first transfer path 6. The first transfer path 6 is branched into a transfer path 8 for transferring normal notes to a note collecting section to be described later and another transfer path 9 for transferring worn-out notes. Provided at the branching point of those transfer paths, a branching means 10 is controlled by a signal derived from a note shift circuit to be described later. The transfer path 8 is further branched into a transfer path $8_1$, for transferring normal notes into a first normal note collecting section $11_1$, and a transfer path $8_2$ for transferring normal notes to a second normal note collecting section $11_2$. Provided at the branch point of these transfer paths, a sorting means 12 is controlled by a signal from a counter circuit to be described later.

The transfer path 9 is branched into a transfer path $9_1$ for transferring worn-out notes to a first worn-out note collecting section $13_1$, and a transfer path $9_2$ for transferring worn-out notes to a second worn-out note collecting section $13_2$. A sorting means 14 provided at the branching point is controlled by a signal derived from the counter circuit. Each of the collecting sections $11_1$, $11_2$, $13_1$ and $13_2$, which collect the notes in a stacked manner, is provided with a bottom plate vertically movable under control of a signal from the counter circuit.

A normal-note-stack transfer section 15 is located at the lower portion of the normal note collecting sections $11_1$ and $11_2$ and is used commonly for them in order to transfer the note stacks taken out from the normal note collecting sections $11_1$ and $11_2$ to a bundling section 16 where those note stacks are bundled by a string so as to keep it in shape. The normal-note-stack transfer section 15 then transfers the bundled stacks from the bundling section 16 to a stack inverting section 17. The stack inverting section 17 sets the note stacks transferred to be in an erect position and then transfers them to a stack transfer section 21. The stack transfer section 21 transfers the note stacks to a bundled stack check section 22. The bundled stack check station 22 is provided in the midportion of the stack transfer section 21 and checks whether the stack is properly bundled or not. A stack reject collecting section 25 is disposed at the terminal portion of the stack transfer section 21. The stack reject collecting section 25 collects the note stacks which are judged to be improperly bundled by the bundled stack check section 22.

A pushing device 23, with a gate 24, provided in the midportion of the stack transfer section 21, pushes out of the stack transfer section 21 the note stacks which are judged to be reliably bundled by the bundled stack check section 22. The gate 24 retains the note stacks until the pushing device 23 pushes out the note stacks. The next stack is laid on the note stack which was pushed out and laid down by the pushing device 23. The two stacks laid one upon another are transferred to the stack collecting section 27 by means of the stack transfer section 26. The stack collecting section 27 collects a given number of stacks, for example, 10 stacks, by the cooperation of a pushing device of a stack collecting section 27. A bundle of 10 normal stacks are pushed out of the stack collecting section 27 by a 10-stack pushing device 28 and transferred to a waiting section 29. The waiting section 29 feeds the 10-stack bundle into a bundling supply section 30. The bundling supply section 30 feeds the 10-stack bundle fed from the waiting section 29 into a bundling stage 31. The bundling stage ties the bundle of 10 stacks by a proper strip or string in a crossing manner by means of a 90° inverting device to be described later. The 10-stacks (referred to as a bundle) are transferred by a bundle transfer device 32 to a bundle detecting section 33. The bundle detecting device measures the weight or thickness of the bundle to check whether the bundle has 10 stacks or not.

The bundles after being checked are pushed out by a pushing device $34_1$ or $34_2$ and are collected in a bundle collecting section 35. The bundles having an insufficient number of stacks are fed to a bundle reject collecting section 37 by means of a bundle transfer device 36.

The worn-out-note stacks transferred from the worn-out note collecting section $13_1$ or $13_2$ are transferred to the invalidating section 19 by means of the worn-out-note-stack transferring device 18. The invalidating section 19 may be a shredder, but it may be any means, such as burning means or chemical means, for melting the notes by chemicals if the means can invalidate the notes. The remnants of the worn-out notes from the invalidating section 19 are collected by a box 20.

The collecting box 20 is removable so that when it is fully filled with the shreds, it may be exchanged with a new one. The shreds may be bagged when the collecting box 20 is additionally provided with a proper compressing means and a bagging means. In this case, fully bagged shreds are taken out from the box quickly.

The terminal portion of the transfer path 7, which is located near the supply section 1, is provided with the unidentifiable note collecting device 38. The collecting device 38 successively collects the unidentifiable notes (including the invalid notes and the superposed notes) transferred by the transfer path 7 into another collecting box. When the sorting of the given number of notes in the supply section 1 is completed, the collecting box having the notes collected is moved to an operator in preparation for the next sorting. A take-back box 39, which is removably provided near the collecting device 38, accommodates the notes taken back from the collecting section $11_1$ or $11_2$ when an abnormality takes place. A detector 40 is provided in the sheet supply section 1 to detect when the notes set in the sheet supply section 1 are completely taken out. The time until this detecting occurs provides a reference of the comparison made every given number of the notes which will subsequently be described. Detectors 40 to 52 properly located are used to detect the presence of the notes transferred. Those detectors 40 to 52 are each comprised of the combination of a light source and the light receiving element which are disposed oppositely.

A bundle collecting box 35, a key input device 54 and a printer 55 are provided near the sheet supply section 1. The bundle collecting box 53 accommodates the bundles of the note stacks each including 100 notes. The key input device 54 is comprised of ten keys 85 by which an operator counts the number of the invalid notes and the superposed notes collected in the unidentifiable note collecting device 38 and keys in the result of the counting, a display device 90 for displaying the data inputted by the ten keys 85, another display device 87 for displaying the invalid and superposed notes included in a stack or batch of notes that an operator now operates, a receipt outlet of a pringer 55 and a note outlet of the unidentifiable collecting device 38. When there is a stack including an insufficient or excessive number of the notes, the printer 55 prints out such information on a receipt or the like.

Figure 2A:
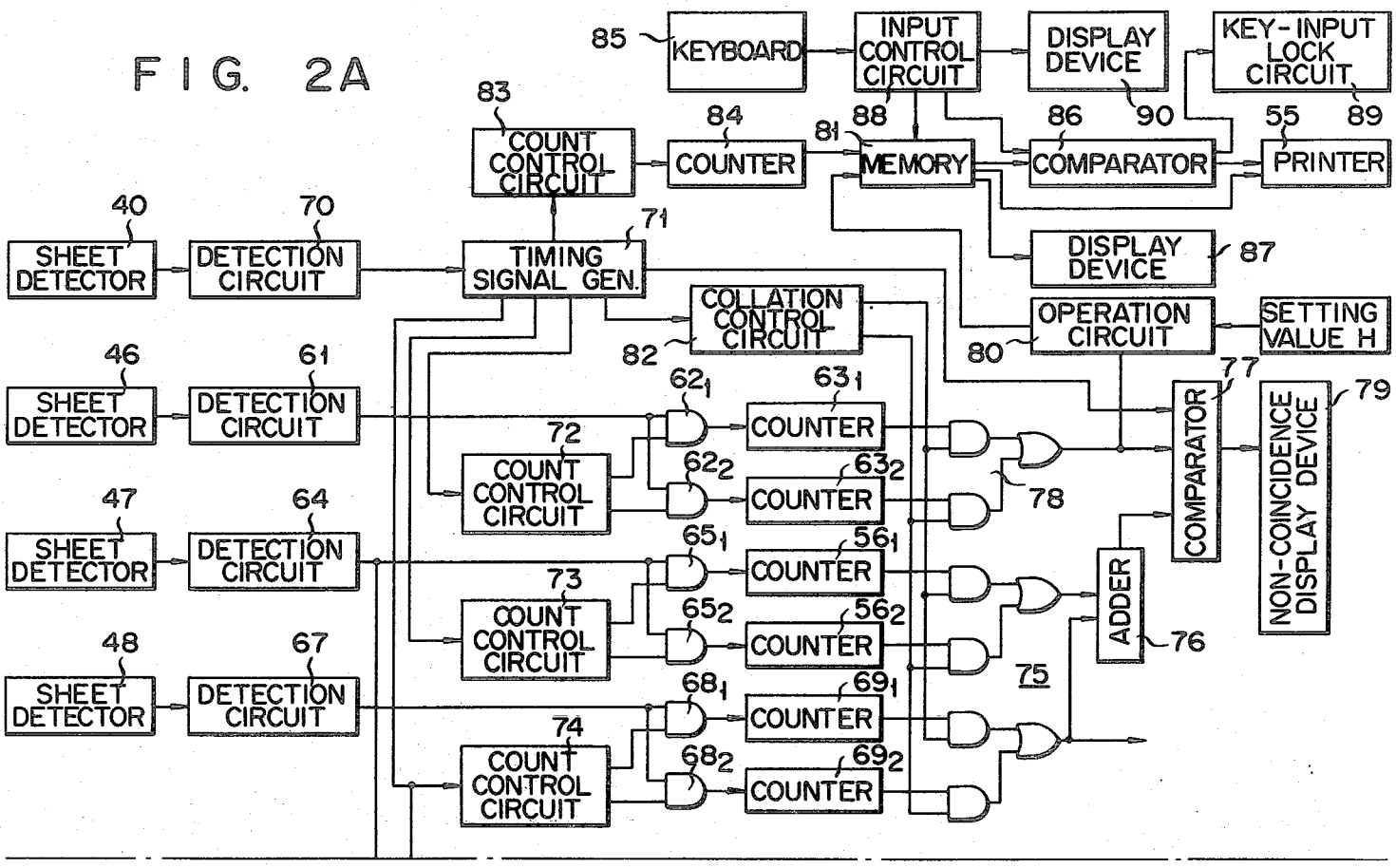
FIGS. 2A to 2C cooperate to form a circuit construction of a counter.
Figure 2B:
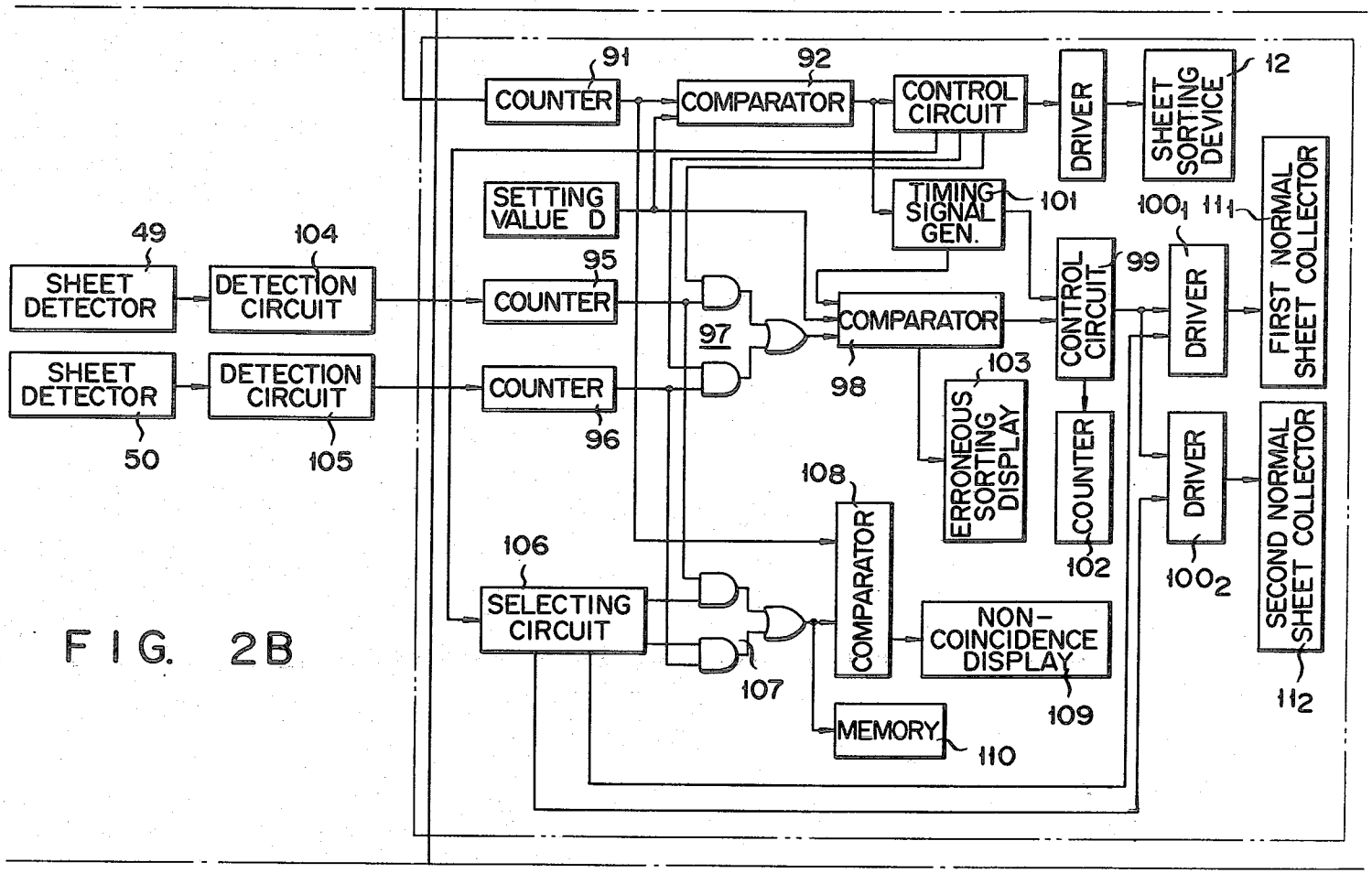
Figure 2C:
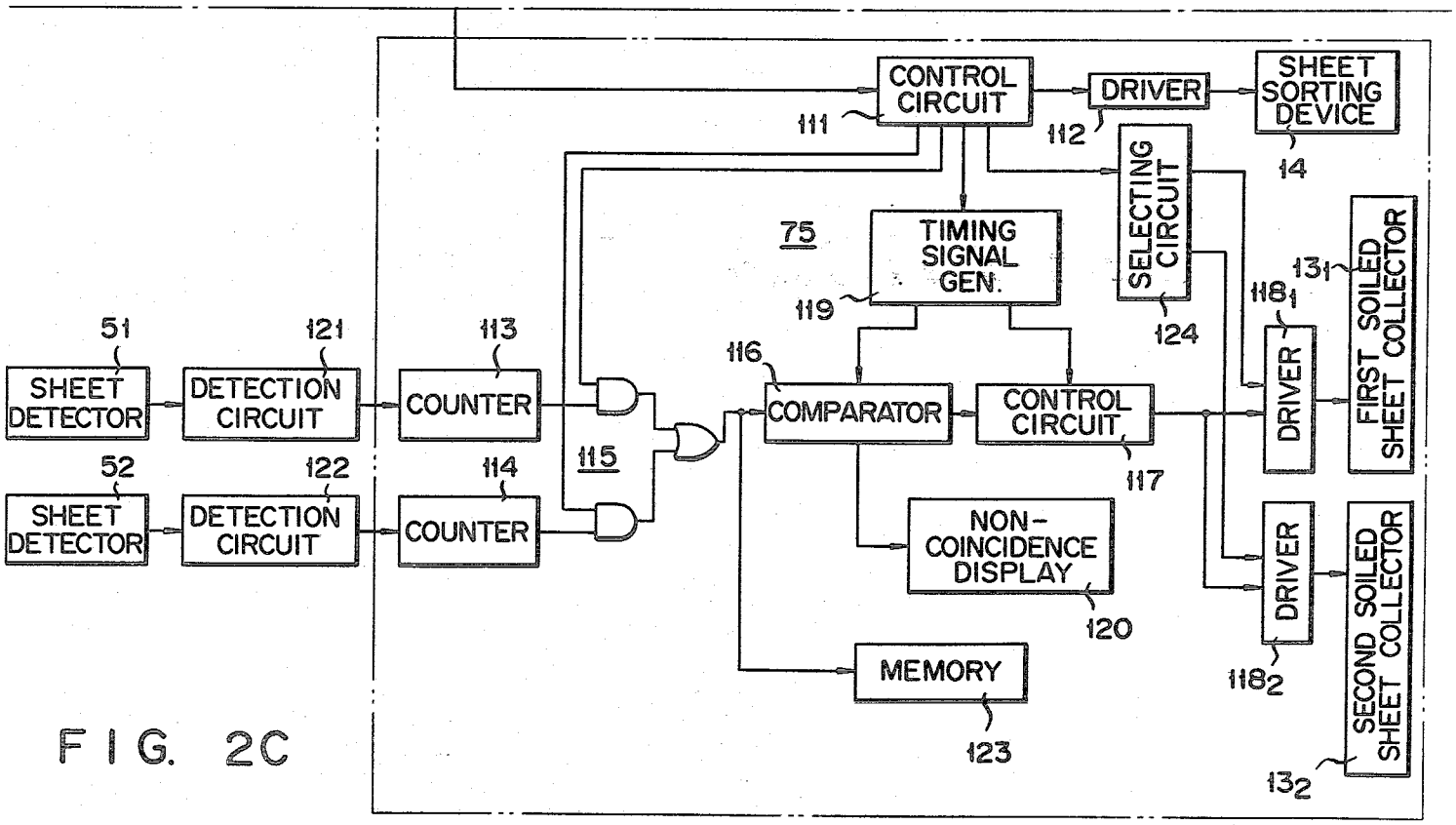

A counter circuit of the sorting apparatus will be described. The counter circuit, which is constructed as shown in FIGS. 2A to 2C, counts the number of notes collected in the normal note collecting sections $11_1$ and $11_2$ and worn-out note collecting sections $13_1$ and $13_2$, temporarily stores the number of these notes, compares the sum of the number of these notes and the number of invalid and the superposed notes inputted from the key input device 54 with a set value H as a specified number (100) of notes. When the counted number of notes equals the set value H, the sum of the notes collected in the unidentifiable note collecting section 38, the normal note collecting sections $11_1$ and $11_2$, and the worn-out note collecting sections $13_1$ and $13_2$ in accordance with the result of the sorting, is H. An output of a detector circuit 61 connected to the detector 46 is applied to total number counters $63_1$ and $63_2$ through AND circuits $62_1$ and $62_2$. An output of a detector circuit 64 connected to the detector 47 is applied to total number counters $56_1$ and $56_2$ through AND circuits $65_1$ and $65_2$. An output of a detector circuit 67 connected to the detector 48 is applied to total number counters $69_1$ and $69_2$ through AND circuits $68_1$ and $68_2$. An output of a detector circuit 70 connected to the detector 40 is applied to a timing signal generating circuit 71. A given timing signal is applied from the timing signal generating circuit 71 to count control circuits 72, 73 and 74. AND circuits $62_1$, $62_2$, $65_1$, $65_2$, $68_1$ and $68_2$ are controlled by those control circuits 72, 73 and 74 so that counters $63_1$, $56_1$ and $69_1$ and the counters $63_2$, $56_2$ and $69_2$ alternately operate. Once a given period of time has lapsed after the detector 40 detects that a given number of notes have been taken out, the contents of the counter $56_1$ ($56_2$) and the counter $69_1$ ($69_2$) are applied to an adder 76 through a gate circuit 75 where those are added to each other, the result of the addition is applied to a comparator 77. The contents of the counter $63_1$ ($63_2$) are applied through a gate circuit 78 to the comparator 77 where those are compared with the output of the adder 76. If both are not coincident with each other as a result of the comparison, the sorting apparatus is in normal condition. Therefore, in this case, the noncoincidence between them is displayed by a noncoincident display unit. On the other hand, if both are coincident with each other, the sorting apparatus obtains a difference between the contents of the counter $63_1$ ($63_2$) and the set value H by an arithmetic logic circuit 80 and stores the difference in a memory circuit. The gate circuits 75 and 78 are controlled by the timing signal generating circuit 71. The timing signal from the timing signal generating circuit 71 is applied to a counter 84 through the count control circuit 83. The counter 84 counts the batch or stack of the notes sorted. The contents of the counter, together with the results of the computation by the arithmetic logic circuit 80, is stored in the memory circuit 81. The operation that the arithmetic logic circuit 80 calculates a difference between the contents of the counters $63_1$ and $63_2$ and the set value H and stores the result of the operation into the memory unit 81 is performed every given time lapse after the batch of notes is taken in. In this case, two sets of the counters $63_1$, $56_1$ and $69_1$ and $63_2$, $56_2$ and $69_2$ are used, the verification may be continued without the stoppage of the transfer of the notes.

The detailed explanation of the memory unit 81 will be described referring to FIG. 3. As shown, the memory unit 81 includes memory addresses ranging from address 1 to address n and address n+1 to address n+9. The memory area from address 1 to addres n stores correspondingly the contents of a counter representing what batch is sorted, that is, the number of the batch, and differences between the contents of the counters $63_1$ ($63_2$) which is the sum of the notes collected in the normal note collecting sections $11_1$ and $11_2$ and those collected in the worn-out note collecting sections $13_1$ and $13_2$ and the set value H, that is to say, the result of the operation of the arithmetic logic circuit 80. More specifically, when the first batch is stored, a value "1" representing the sorting of the first batch and the result Q1 of the arithmetic logic circuit 80 are stored in the first address. When the second batch is sorted, a value "2" representing the sorting of the second batch and the result Q of the operation by the circuit 80 at that time, are stored in the second address. In this way, those data are successively stored in the memory locations up to the address n. When the storing of those data into the address n is completed, the storing operationg returns to the operation to the first address. At this time, the contents previously stored in the address 1 is cleared and then a value (n+1) representing the (n+1)th batch and the result Qn+1 of the arithmetic logic circuit 80 are stored in the address 1. The memory contents of the address 1 is not necessary since the comparison of the sum of the invalid notes and the superposed notes inputted by the ten key 85 with the memory contents of the address 1 will be completed in the comparator 86 before the memory contents in the address n+1 is necessary. Subsequently, the data of the (n+2) and the succeeding batches will be stored in the second and succeeding addresses in a similar manner. The memory area from address 1 to address n has a memory capacity enough to cover a time difference between the sorting of the normal and worn-out notes and the verification by the ten key 85, so as not to stop the sorting operation. The number of the batch which is now verified by the ten key 85 is stored in the address n+1 and the memory contents is displayed by the display unit 87. For example, when the invalid notes and the superposed notes included in the first batch is inputted by the ten key 85, the numeral "1" is stored in the address n+1. "1" is added to the contents of the address n+1 every time the numbers of the invalid notes and the superposed notes of the succeeding batch are inputted. The addresses n+2, n+3 and n+4 store the sum of the invalid notes and the superposed notes inputted by the ten key 85, the number of the notes reapplied because of erroneous inputting, the total sum of the invalid notes and the superposed notes of the previous batch. Similarly, the addresses n+5, n+6 and n+7 store the number of the invalid notes, the invalid notes which had been processed fill the previous storing operation.

The numbers of the invalid notes and the superposed notes thus keyed in by the ten key 85 is supplied to the comparator 86 through the input control circuit 88, and also to the memory unit 81 where the above-mentioned storing operation is performed. Upon the keying in, the memory unit 81 selects the number corresponding to the contents of the address n+1 from the addresses 1 to n and reads out the result of the operation stored corresponding to the number selected and supplies the result of the operation to the comparator 86. The comparator 86 compares the operation result supplied from the memory unit 81 with the numbers of the invalid and superposed notes already inputted thereby to effect the count and the verification. In the verification, if there is noncoincidence therebetween, the numbers of the invalid notes and the superposed notes included in the next stack are keyed in by the ten keys 85. When those are keyed in, the memory unit 81 adds the contents of the addresses n+3 and n+6 to the contents of the addresses n+4 and n+7 and again stores the result of the addition into the addresses n+4 and n+7. At this time, the memory unit 81 adds "1" to the contents of the address n+1 and stores the result of the addition, while at the same time stores the sum of the numbers of the invalid and superposed notes and the number of the invalid notes in the addresses n+2 and n+5. The operation as mentioned above will be repeated. When the comparing operation provides that the stack includes incorrect number of notes, the display unit displays (not shown) to that effect. Also at this time, the key input lock circuit 89 operates to electrically lock the key input device. At this time, the value representing the number of the notes keyed in by the ten key 85 is displayed by the display 90. After seeing the display, an operator reinputs the correct number of the notes, if an erroneous keying in is found. The reinput number of the notes is applied to the comparator 86 where it is again compared with the result of the operation. When both are coincident with each other, the printer 55 operates to print out on the printing receipt the contents (the number of the stacks) of the address n+1 of the memory unit 81, the numerical value inputted by the ten key 85, that is, the contents of the address n+2, and the numerical value reinputted, that is, the contents of the address n+3. When the number of the notes previously inputted is correct and the reinput provides only noncoincidence, the key input device 47 is locked. When the supervisor release the lock of the key input device, the printer 48 operates to print out the contents of the addresses n+1 and n+6. The key input device 54 is also locked when the contents of the addresses n+1, n+2 and n+6 and a numerical value other than "0" are inputted as a result of the judgement by the comparator that the invalid note is included the note stack. After the storing operations are all completed and the count and verification by the input from the ten key 85 is completed, depression of a button (not shown) operates the printer 55 to print out the contents of the addresses n+1, n+4 and n+7 of the memory unit 81, that is, the number of the notes included in a stack, the total number of the invalid and superposed notes, and the total number of the invalid notes. The operator can check the numbers of the invalid notes and the superposed notes by the print.

How to check the number of the notes collected in the respective collecting sections will be described. When the contents of a counter 91 for counting the output signal from the detector 47 coincides with a set value D (100 in this example), a coincident signal is produced by a comparator 92. In response to the coincident signal, the sorting control circuit 93 and the drive circuit 94 drive the sorting apparatus. At this time, the notes transferred are collected in another normal note collecting section. Let us consider a case that 100 notes are first collected in the first normal collecting section $\mathbf{11}_1$ and the sorting device 12 is switched to collect the notes in a second normal collecting section $\mathbf{11}_2$, the contents of the counter 95 selected through a gate circuit 97 by the control circuit 93 and the set value D are compared with each other by the comparator 98. When both are coincident with one another as a result of the comparison, a collecting control circuit 99 and a drive circuit $\mathbf{100}_1$ drives the first normal note collecting section $\mathbf{11}_1$ and the stacks each including 100 notes are carried out. The operations of the comparator 98 and the control circuit 99 are performed in response to a given timing signal produced from a timing signal generating circuit 101. The timing signal generating circuit 101 operates in response to an output signal from the comparator 92. At the time that the operation of the first normal note collecting section $\mathbf{11}_1$ ends simultaneously with the carry-out of the stack of 100 notes, the normal note stack counter 102 is incremented by "+100". When the result of the comparator 98 is the noncoincidence, the error sorting display 103 operates and the sorting apparatus is in an abnormal mode. The counters 95 and 96 perform the count operations when receiving the output from the detecting circuits 104 and 105 connected to the detectors 49 and 50.

The control circuit controls the collecting circuit 106 as a selecting circuit by which the drive circuit 106 selects the counters 95 and 96 through the gate circuit 107. The contents of the counter is supplied to the comparator 108. The comparator 108 compares the contents of the counter 91 with the contents of the counter 95 or 96. When both are not coincident with each other, the noncoincident display is driven. The contents of the counter 95 or 96 selected by the selecting circuit 106 is stored into a memory unit 110.

When the normal note stack counter 102 is incremented by "100", the address n+9 of the memory unit 81 stores data with "+1", that is, it stores the number of the normal stacks processed.

In the case of the worn-out note, in response to the signal from the timing generating circuit 71, the sorting control circuit $\mathbf{11}_1$ and the drive circuit $\mathbf{11}_2$ drive the sorting apparatus 14. The worn-out notes of a given number (H) are collected in another worn-out notes collecting section. For example, the first worn-out notes of the given number (H) is collected in the first worn-out note collecting section $\mathbf{13}_1$. Then, the sorting device is switched so that the second worn-out notes are collected in the second worn-out note collecting section $\mathbf{13}_2$. The contents of the counter 113 selected through the gate circuit 115 by the control circuit 111 is compared with the contents of the counter $\mathbf{69}_1$ selected through the gate circuit 75 by means of a comparator 116. Incidentally, a delay circuit provided in the comparator 116 time-adjusts the signals from the counters 113 and 114 so that those are coincident with each other in the timing. When both are coincident with each other as a result of the comparison, the collecting control circuit 117 and the drive circuit $\mathbf{118}_1$ immediately drive the first worn-out note collecting circuit $\mathbf{13}_1$. As a result, the first damaged note of the given number (H) are carried out and the first worn-out notes of the given number (H) are transferred to the shredder 19 by the worn-out note stack transfer device 18. The operations of the comparator 116 and the control circuit 117 are performed in response to a given timing signal outputted from the timing signal generating circuit 119 which is driven by the output signal from the control circuit 111. When both are not coincident with each other in the comparison, the noncoincident display 120 operates, so that the sorting apparatus is in the abnormal condition. When supplied with the outputs of the detecting circuits 121 and 122 connected to the detectors 51 and 52, the counters 113 and 114 perform the counting operations.

With respect to the counters 113 and 114, when both are not coincident with each other, the contents of the counter 113 or the counter 114 selected by the control circuit 111 is stored in the memory circuit 123. The collection selecting circuit 124, which is controlled by the control circuit 111, selects the drive circuits $118_1$ or $118_2$. When both are coincident with each other, the contents of the counter 113 or 114 is added to the number of the worn-out notes at the previous stage and the added one is stored in place of the contents stored in the address n+8 of the memory unit 81 (third time). This is for the reason that since the worn-out notes are shredded to lose its original shape, it can not confirm the number of the worn-out notes. For avoiding this, the number of the worn-out notes processed are stored and after a given time, the total number of the worn-out notes having been processed at that time is printed out for the check of it.

When an abnormal state such as jam, shift error or counting nonverification, takes place, all the normal notes and the worn-out notes are not taken out from all the normal and worn-out note collecting sections but the number of the notes collected in the unidentifiable note collecting section 38 ae totaled to check the used number of the notes supplied. The number Q of the notes within an unidentifiable collecting section 38 when the sorting apparatus is in a normal condition is given $$Q=H-G1(G2)$$

where G1 (G2) is the contents of the counter $63_1$ ($63_2$).

When an abnormality takes place in the apparatus, the total number of the notes taken out from the normal and damaged note collecting sections $11_1$, $11_2$, $13_1$ and $13_2$ and the notes in the unidentifiable notes are given below.

(1) When an abnormality takes place under a condition that only one stack is supplied:

$$Q=H-G-RA+RU-PU$$

where

G . . . G1+G2

RA . . . The contents of the memory device 123

RU . . . The contents of the memory unit 110

PU . . . The contents of the counter 102

(2) When an abnormality takes place under a condition that the nth and the (n+1)th bundles are supplied:

$$Qn=H-Gn+RA+RU-PU+Gn+1TR$$

$$Qn+1=H-Gn+1TR-Gn+1$$

where

Gn . . . The contents of the counter $53_1$ ($53_2$) for the nth stack

Gn+1TR . . . The number of the notes of the (n+1)th stack supplied during a period from an instant that the abnormality takes place till it is cleared (the contents of the counter $53_2$($53_1$))

Gn+1 . . . The number of the notes of the (n+1)th stack

Figure 4:
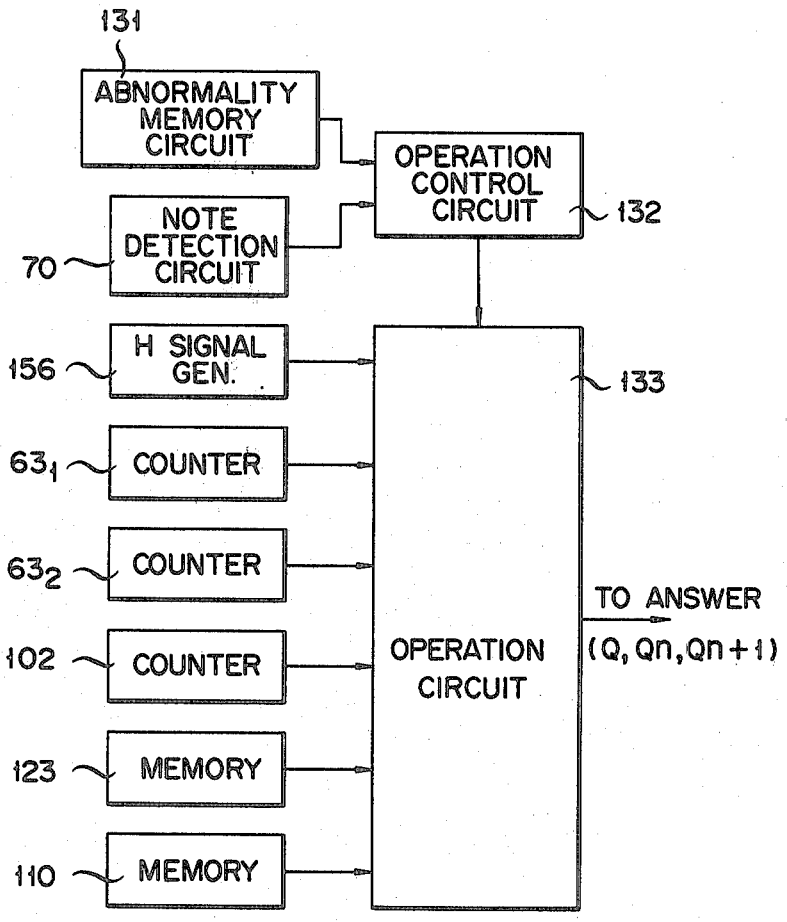
FIG. 4 is a block diagram of an arithmetic logic circuit used in the sorting apparatus of the invention.

Through the operation as mentioned, the counting and verification may be performed. Accordingly, by the circuit shown in FIG. 4, for example, the number of the notes sorted into the normal notes collecting sections $11_1$ and $11_2$ and the worn-out sheet collecting sections $13_1$ and $13_2$ are obtained and the number of the notes obtained, together with the signal when the abnormality takes place, is stored into the addresses 1 to n of the memory unit. In FIG. 4, the memory circuit 131 stores those when the abnormality occurs. The set value H, 56 the contents of the counters $63_1$, $63_2$, 102 and the memory circuits 110 and 123 are supplied to an operation control circuit 132 and the arithmetic logic circuit 133. Then, those circuits cooperate to perform the above-mentioned operation and to provide the results of the operation (Q1, Qn, Qn+1).

Figure 5:
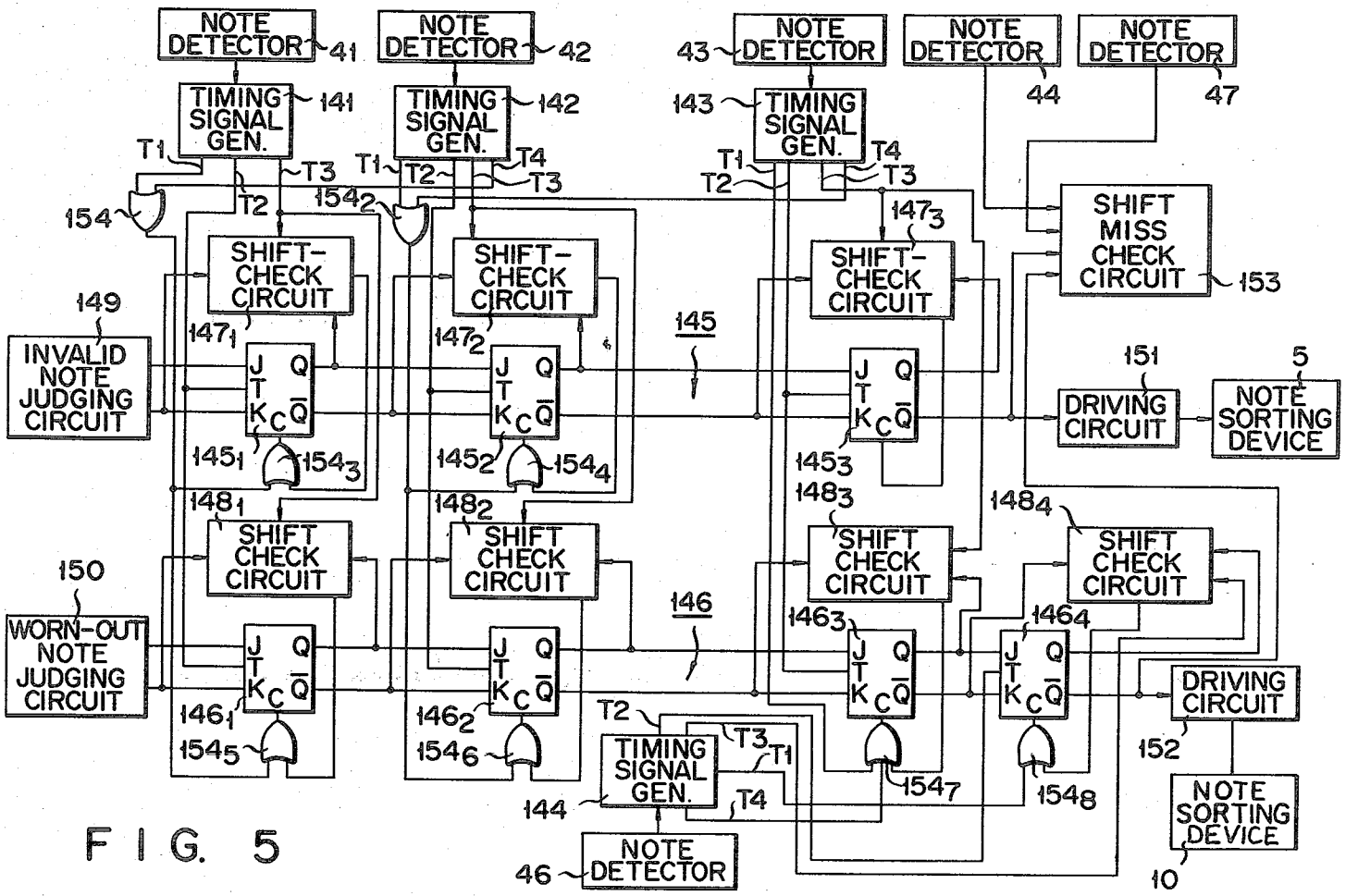
FIG. 5 is a block diagramk of a sheet shift circuit.

The detail of the note locating circuit utilized in the apparatus of this invention will now be described with reference to FIG. 5. The note locating circuit is constructed to shift a signal produced by the aforementioned detecting device 4 and representing the result of judgement in accordance with the conveyance of corresponding notes and utilized to control the sorting devices 5 and 10 for sorting the notes into normal notes, damaged notes and rejective notes. As shown, detectors 41, 42, 43 and 44 are connected to timing signal generators 141, 142, 143 and 144, respectively. The timing signals T1, T2, T3, and T4 produced by these timing signal generators are respectively supplied to J-K flip-flop circuits $145_1$, $145_2$, $145_3$, $146_1$, $146_2$, $146_3$ and $146_4$ which constitute shift registers 145 and 146, and also to shift checking circuits $147_1$, $147_2$ and $147_3$; and shift checking circuits $148_1$, $148_2$, $148_3$ and $148_4$. In the detecting device 4 an invalid note judging circuit 149 and a worn-out note judging circuit 150 are provided. The output of the invalid note judging circuit 149 is connected to the input of shift register 146, that is the J and K input terminals of the first stage flip-flop circuit $146_1$, whereas the output of the damaged note judging circuit 150 is coupled to the J and K input terminals of the first stage flip-flop circuit $146_1$ of the shift register 146.

Where the conveyed notes are not the invalid notes, the invalid note judging circuit 149 sets the flip-flop circuit $145_1$ to an "1" state. When the leading edge of a note reaches the detector 71 located at the exit of the detecting device 4, the timing signal generator 141 generates a timing signal T1 which functions to clear the flip-flop circuit $146_1$ of the shift register 146. This flip-flop circuit $146_1$ is triggered by the timing signal T2 to set the data produced by the invalid note judging circuit 149 in the first stage flip-flop circuit $145_1$ of the shift register 145. In response to the timing signal T3 the shift checking circuit $147_1$ checks whether this data has been positively set in the flip-flop circuit or not. Where the result of the check shows that a different data has been set, the shift register 145 would be cleared. When the leading edge of the note reaches the next note detector 42, the timing signal generator 142 generates timing signals T1 through T4 in the same manner as above described to shift the content of the first stage flip-flop circuit $145_1$ to the second stage flip-flop circuit $145_2$. The timing signal T4 is used to clear the first stage flip-flop circuit $145_1$ after its content has been shifted to the second stage flip-flop circuit $145_2$. The flip-flop circuit $145_3$ is arranged to be set when the leading edge of the note reaches the note detector 43 located immediately before the next sorting device 5, and the drive circuit 151 of the sorting device 5 is controlled in accordance with the content of the flip-flop circuit $145_3$. More particularly, where the output of the flip-flop circuit $145_3$ is a "0", the sorting device 5 is controlled such that the notes would be conveyed to the rejective note collector 38.

On the other hand, where the notes being conveyed are not damaged notes, the damaged note judging circuit 248 sets the flip-flop circuit $146_1$ to the "1" state. More particularly, by the timing signal T2 which is generated by the timing signal generator 141 after the leading edge of the note has reached the note detector 41, the flip-flop circuit $146_1$ would be set to the "0" state if the note is a damaged one. Thereafter the content of the shift register 146 is shifted in the same manner as above described.

When the leading edge of a note reaches a note detector 46 located immediately before the normal/damaged sorting device 10, and when data are set in the flip-flop circuit $146_4$, the drive circuit 152 of the sorting device 10 would be controlled in accordance with the output of the flip-flop circuit $146_4$. In other words, when the output of the flip-flop circuit $146_4$ is "0", the sorting device 10 would be controlled so that the notes would be conveyed to the damaged note collector $13_1$ ($13_2$). In FIG. 5, reference characters $154_1$ through $154_8$ designate OR gate circuit.

The "0" set state of shift registers 145 and 146 is determined by considering the accuracy at the time of sorting the notes. More particularly, while a signal "1" is being shifted through the shift registers, even when this signal is caused to disappear due to external noise or the like, the notes would be sorted into a collector having a higher degree or priority. For example, when the note with a worn-out signal loses its signal, the note is sorted into the invalid note collecting device 26. For example, when the FF circuit $145_3$ of the shift register 145 is "0", that is, when the sorting device 5 is directed so as to transfer the notes to the unidentifiable note collecting section 38, the shift miss check circuit 153 operates to check the notes when the notes pass the detector 44. The shift miss check circuit 153 is also connected to the detector 47 and similarly performs the check when the worn-out notes are transferred to the normal note collecting sections $11_1$ and $11_{11}$.

Figure 6:
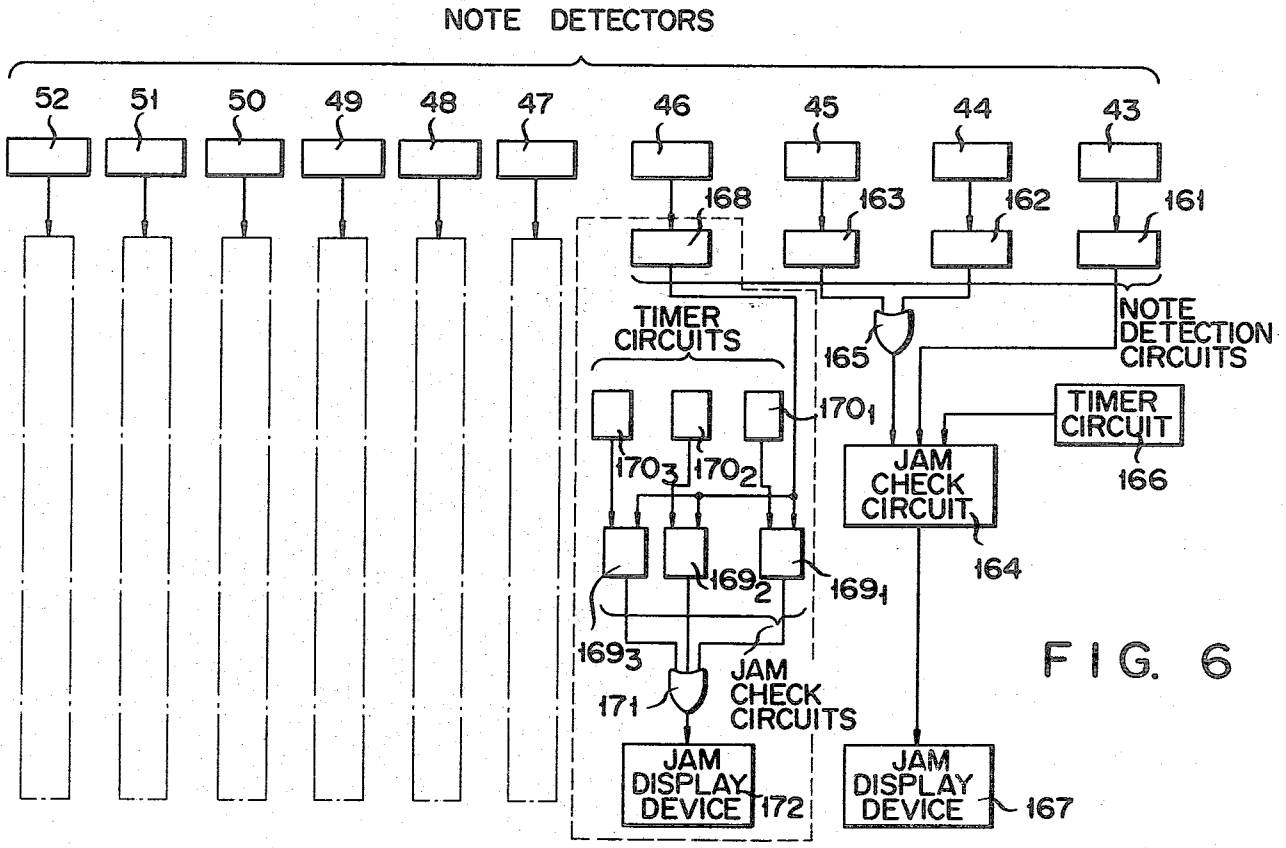
FIG. 6 is a block diagram of a jam detecting circuit used in the sorting apparatus.

The jam detecting circuit used in the sorting apparatus will be described. The jam detecting circuit quickly detects some trouble occurring in the midway of transferring a single note. This circuit is constructed as shown in FIG. 6, for example. As shown, detecting circuits 161, 162 and 163 are connected to the detectors 43, 44 and 45, respectively. The output from the detecting circuit 161 is connected to a jam check circuit 164. The outputs from the detecting circuits 162 and 163 are supplied to the jam check circuit 164 through an OR circuit 165. The jam check circuit 164 is also coupled with the output signal from a timer circuit 166. In part of the sorting device 5, the jam check circuit 164 checks the arrival time of a note at the detector 44 or 45 after it passed the detector 43. When the arrival time checked is longer than a time set by the timer circuit 164, the jam check circuit judges that the note is jammed in the sorting device 5, thereby to produce a signal. The jam signal then is displayed by a jam display 167. A detecting circuit connected to the detector 46 is coupled for application with jam check circuits $169_1$ to $169_3$ which are coupled for receiving with the outputs from the timers $170_1$ to $170_3$. The outputs from the jam check circuits $169_1$ to $169_3$ are applied through an OR circuit 171 to a jam display 172. Accordingly, in the part of the sorting apparatus, the jam check circuit $169_1$ checks a time the note passes the detector 46. When the time checked is longer than a fixed time set by the timer $170_1$, the jam check circuit judges that jam occurs in the sorting device 10 or that two or more notes are continuously transferred, whereby it produces a signal representing it. When the jam check circuit $169_2$ checks the time the note passes the detector $169_2$, if the time checked is shorter than the fixed time, the jam check circuit judges that the note is skewed or that something other than the note is transferred. As a result, the jam check circuit $169_2$ produces a signal representing the judgement. Further, the jam check circuit $169_3$ checks a time interval between two successive notes passing the detector 46. In the check, when the time interval is shorter than a fixed time set by the timer $170_3$, the jam check circuit judges that the interval of the note therebetween is too short and produces a signal. Those signals produced by the jam check circuits $169_1$ to $169_3$ are applied to the jam display 172 for display them.

The circuit connection and operation as mentioned above relating to the detector 46 are correspondingly applied to the remaining detectors 47 to 52.

FIGS. 7A to 7H illustrate the stack collecting section of the apparatus shown in FIG. 1.

Figure 7A:
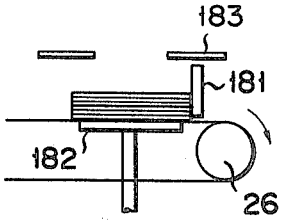
FIGS. 7A to 7H schematically illustrate the operation of a bundled sheet-stack collecting section of the sorting apparatus shown in FIG. 1.

In FIG. 7A, the normal note transferred by the stack transfer device 26 is stopped by a stopper 181. A microswitch (not shown) of the stopper 181 detects that the normal notes arrives at the pushing device 182 to produce a signal to drive the pushing device 182.

Figure 7B:
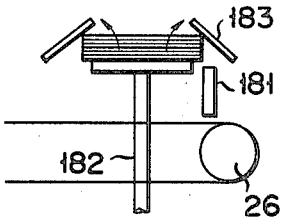
Figure 7C:
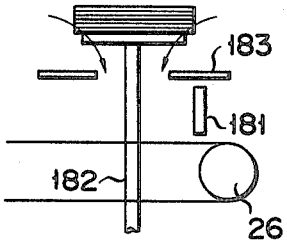
Figure 7D:
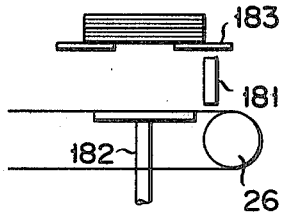
Figure 7E:
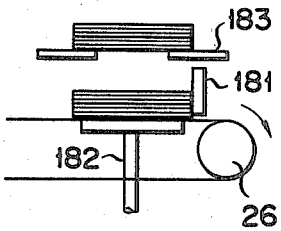
Figure 7F:
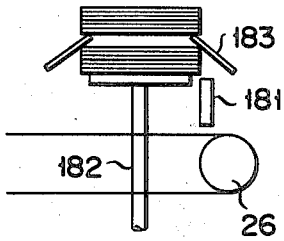
Figure 7G:
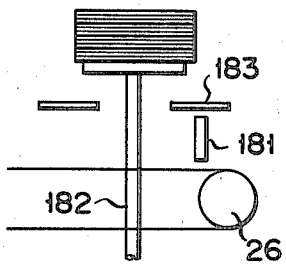
Figure 7H:
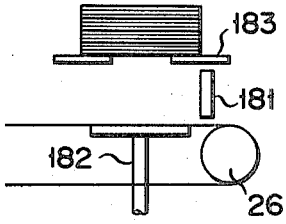

FIG. 7B illustrates a state that the pushing device 182 pushes up the stacks. The stacks pushed up opens a gate 183 which opens upwardly to both sides. As shown in FIG. 7C, when the stacks are pushed up to a position where it does not interfere with the gate 62, the gate 183 closes. The pushing device is vertically movable through the gate 183 without interfering with the gate. As shown in FIG. 7D, the pushing device 182 descends below the gate 183 leaving the stacks on the gate. At this time, a counter (not shown) advances by one in response to the operation of the pushing device. When the contents of the counter becomes 5, the 10-stack pushing device 28 operates to send the 10 stacks to the waiting section 29. FIGS. 7E to 7H illustrate an operation of the stack collecting section 27 when the next stacks reach. The above-mentioned operation is correspondingly applicable for this operation. Therefore, no elaboration of this will be given.

Figure 8:
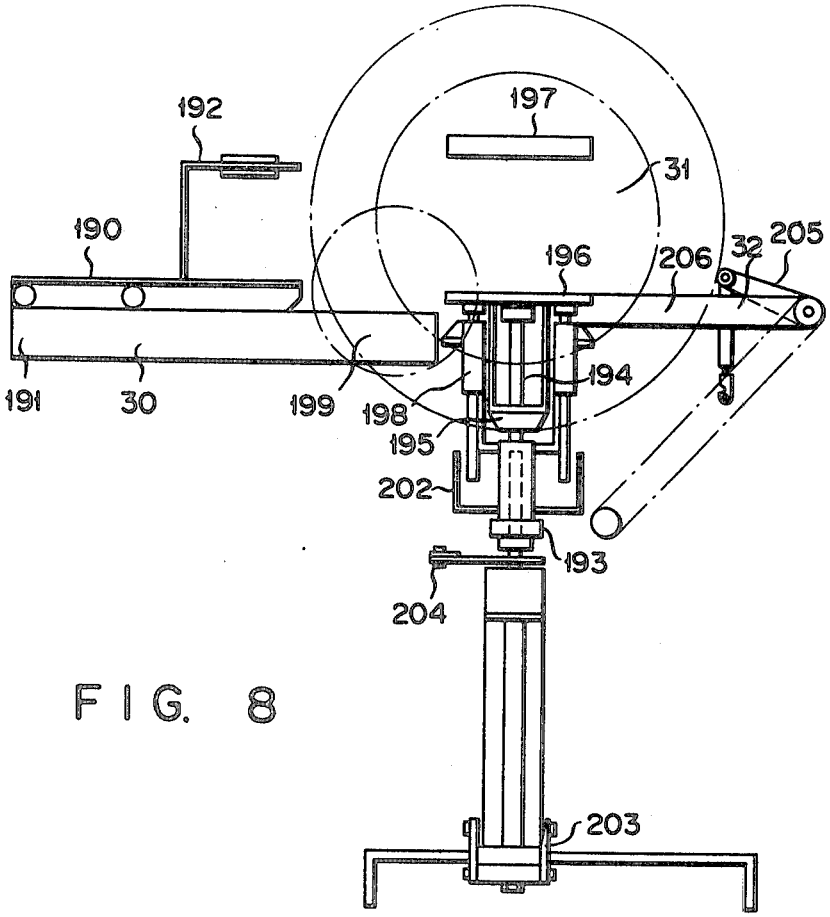
FIG. 8 shows a cross sectional view of a bundling section used in the sorting apparatus shown in FIG. 1.

FIG. 8 shows a cross sectional view of the bundle supply section 30, the bundling section 31 and the bundle carry-out section 32. The bundle supply section 30 is comprised of a bundle supply truck 190, a bundle supply rail 191, and a bundle receiving portion 192. The bundle supply truck 190 moves on the bundle supply rail 191 to put the bundle receiving portion 192 up to the midportion in the bundling section 31 and to supply the bundle of 10 stacks thereto. When 10 stacks are supplied to the bundling section 31, a gear mechanism (not shown) rotates a gear 193 which in turn rotates a shaft 194 to push up a pushing table 195. Then, a lowr chuck 196 is pushed up to compress the 10-stack bundle by the chucks 196 and 197. A vertical slider 198 includes a shaft fixed to the lower chuck 196 and a linear bearing, rectilinearly moves up and down by the rotational force of the pushing table 195 without the rotation of the lower chuck. After the 10-stack bundle is compressed, a band arm 199 is rotated around the 10-stack bundle to wind it by a large strip. Following the completion of the strip winding, a cutter and a pasting means (both not shown) are driven to cut the strip and paste it. When the lower chuck is lowered, the 90° inverting mechanism 202 is raised by an inverting vertical mechanism 203. The 90° inverting mechanism 202 is provided on the inner part of the lower chuck 196 so as to hook the strip tying the bundle. The mechanism 202, when rotating for bundling the bundle, descends so as not to interfere with the band arm 199. When the 90° rotating mechanism 202 rises to catch the bundle, the inverting arm 204 rotates the inverting mechanism 202 by 90° to rotate the bundle by 90°. This is for the reason that the inverting arm 204 is moved by a cam mechanism (not shown) since the vertical shaft has a groove allowing a vertical movement of the 90° inverting mechanism 202 but prohibiting its rotation. When the 90° rotation is completed, the inverting vertical mechanism 203 lowers the 90° mechanism 202. When the mechanism 202 is lowered, the inverting arm 204 moves, so that the mechanism returns to its original state. When the mechanism 202 is lowered, the band arm 199 rotates to wind the bundle by a strip and to cut and paste the strip wound by the cutter and the pasting means. At this point, the cross bundling of the 10 stacks is completed. Following this, the conveyor vertical mechanism 205 of the bundle carry-out section 32 puts the conveyor 206 into the bundling section 31 and carries out the cross-tied bundle with the drive of the conveyor 205. The conveyor 206 is usually placed on the lower side so as not to avoid the interference of the bundling work.

Figure 9:
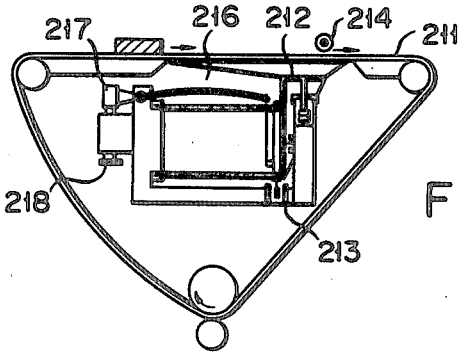
FIG. 9 is a schematic diagram of a bundle detecting section used in the sorting apparatus shown in FIG. 1.

FIG. 9 illustrates a principle of a weight measuring device 210 as an example of the bundle detecting section 33. The bundle is conveyed by the weighing belt 211 to a weighing table 212, so that the weight of the weighing table 212 is lowered due to the weight of the bundle X. A differential transformer 213 measures the amount of the lowering of the weighing table. When the bundle reaches a position detector 214, the differential transformer responds to the signal from the position detector 214 to produce an output signal for transmission to a judging circuit (not shown) where it is compared with a predetermined value. A preloading spring 216 is adjustable in the strength of spring by means of a measuring reference value setting dial through a warm gear 218. In measuring the weight of the bundle, the spring strength of the preloading spring 216 is set to the weight of a reference bundle. The weight-measured bundle is pushed onto the bundle collecting section 35 by means of the pushing device $34_1$ or $34_2$. The pushing devices $34_1$ and $34_2$ alternately operate to arrange the bundles in two lines. When the output signal exceeds the upper or lower limits, the pushing device $34_1$ and $34_2$ do not operate and the bundles are transferred to the bundle reject collecting section 37 by the conveyor 211 of the bundle detecting section 33 and the bundle transfer device 36.

Figure 10A:
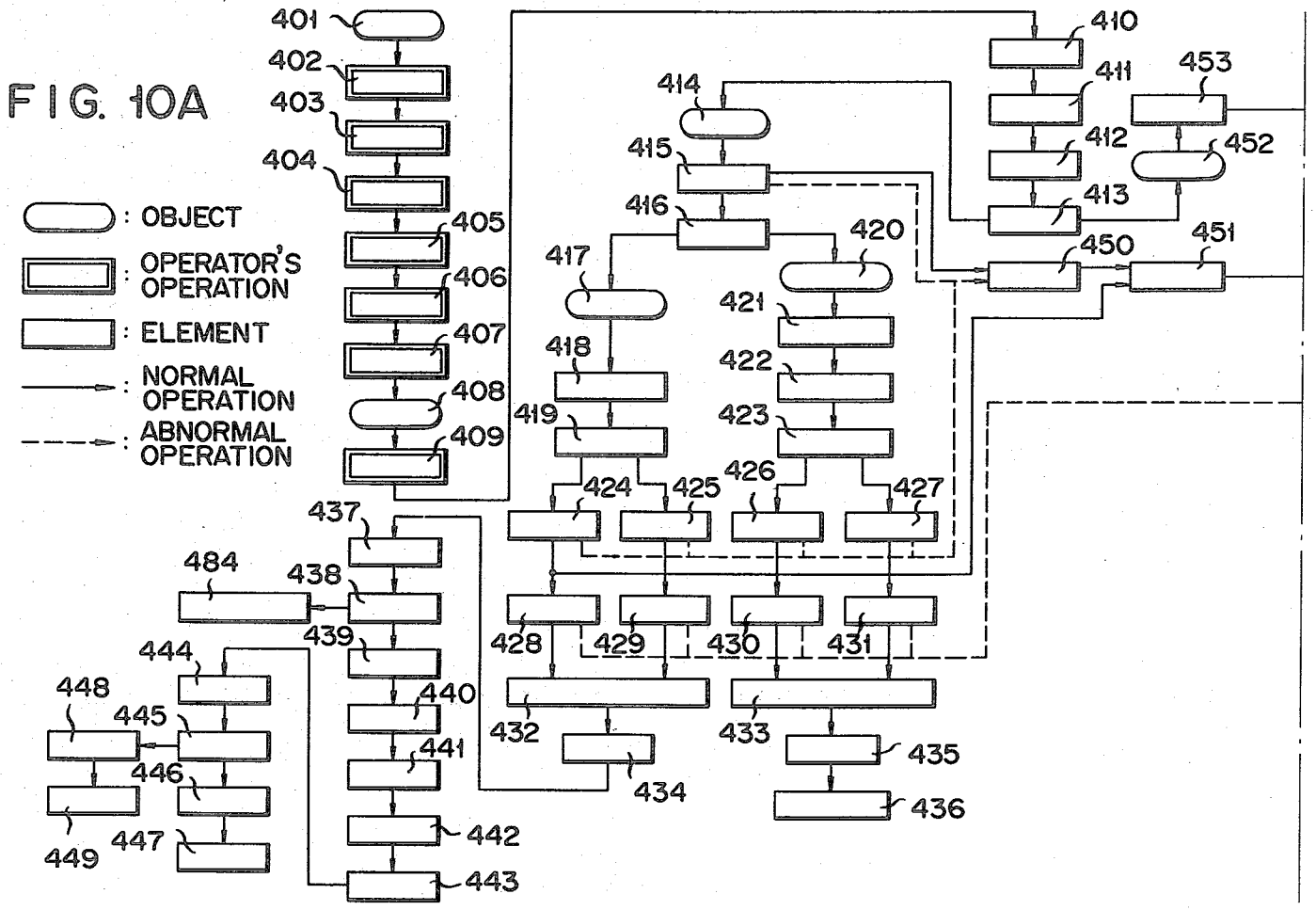
FIGS. 10A and 10B are flow charts useful in explaining the operation of the sorting apparatus shown in FIG. 1.
Figure 10B:
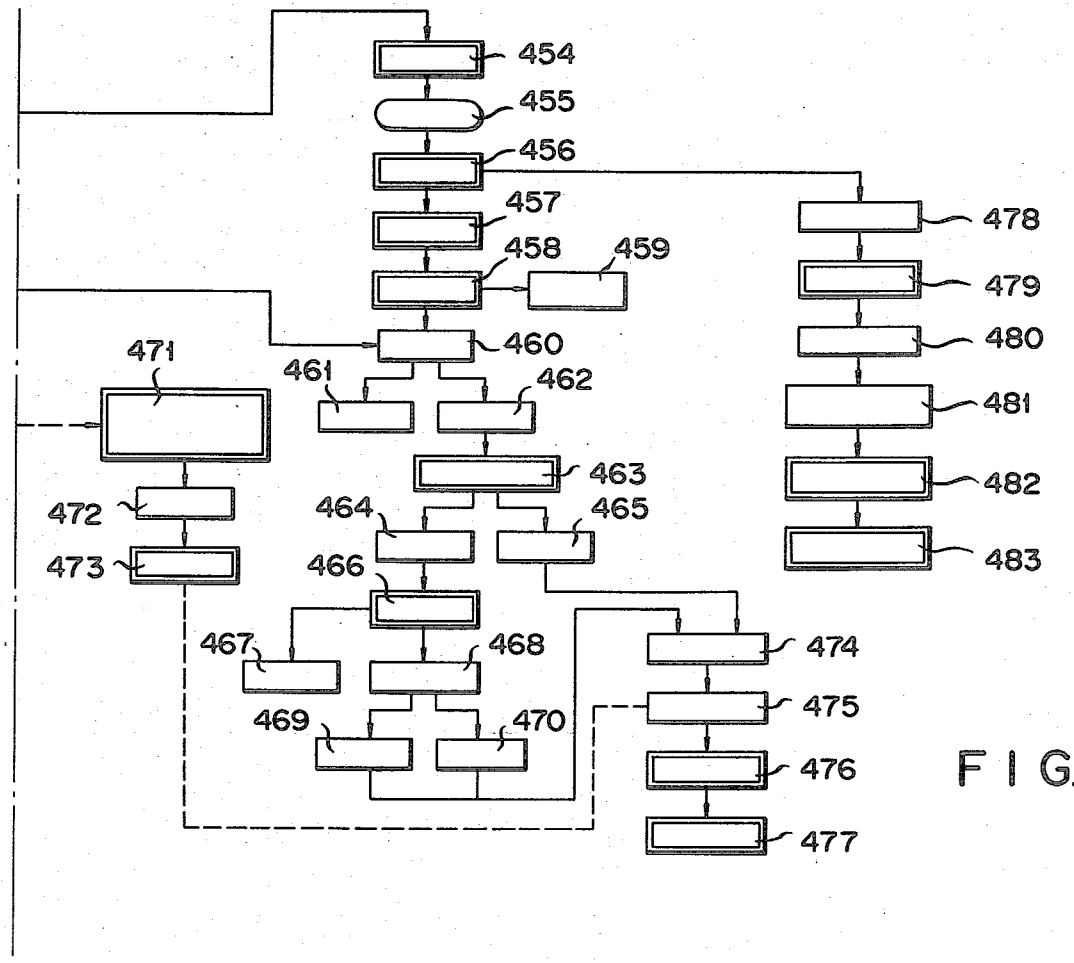

The operation of the sorting apparatus with such a construction will be described referring to FIGS. 10A and 10B. The meaning of the flow chart symbols used in FIGS. 10A and 10B are given on the left hand portion of the FIG. 10A. For a clearer understanding, a bunch of 100 notes bundled is called a stack and a bundle of ten stacks bundled is called a bundle, although these terms have frequently been used in the foregoing description. The contents of the respective blocks with reference numerals attached thereto are as follows:

401 . . . Notes to be sorted
402 . . . Bundles with the numbers on the large strips, including 1,000 notes
403 . . . Cut the large strips
404 . . . Keep the large strips
405 . . . Stacks with the numbers on the small strips, including 100 notes
406 . . . Cut the small strips
407 . . . Keep the small strips
408 . . . Notes (stacks)
409 . . . Set the stacks in the supply section
410 . . . Supply section
411 . . . Take-out device
412 . . . Detecting section
413 . . . Sorting section
414 . . . Normal/worn-out notes
415 . . . Counter
416 . . . Sorting device
417 . . . Normal notes
418 . . . Counter
419 . . . Sorting device
420 . . . Worn-out notes
421 . . . Stamping device
422, 424, . . . 427 . . . Counter
423 . . . Sorting device
428 . . . First normal note collecting section
429 . . . Second normal note collecting section
430 . . . First worn-out note collecting section
431 . . . Second worn-out note collecting section
432 . . . Normal note stack transfer device
433 . . . Worn-out note stack transfer device
434 . . . Bundling device
435 . . . Invalidating section
436 . . . Worn-out note shreds collecting box
437 . . . Stack inverting device
438 . . . Bundling check device
439 . . . Pushing device
440 . . . Stack collecting section
441 . . . Waiting section
442 . . . Bundle supply section
443 . . . Bundling section
444 . . . Bundle carry out device
445 . . . Bundle detecting section
446 . . . Pushing device
447 . . . Bundle collecting section
448 . . . Bundle transfer device
449 . . . Bundle reject collecting section
450 . . . Arithmetic logic circuit
451 . . . Memory unit
452 . . . Invalid note, superposed note
453 . . . Invalid note collecting device
454 . . . Take out invalid notes and superposed notes
455 . . . Invalid note, superposed note
456 . . . Check the invalid notes
457 . . . Count the number of the invalid notes and the superposed notes
458 . . . Key-in the sum of the invalid notes and the superposed notes
459 . . . Input display
460 . . . Comparator
461 . . . Correct number of notes 462 . . . Incorrect number of notes
463 . . . Confirm the number of input notes
464 . . . Erroneous input
465 . . . Correct input
466 . . . Reinput
467 . . . Input display
468 . . . Comparator
469 . . . Correct number of notes
470 . . . Incorrect number of notes
471 . . . Count the number of notes taken out from take-back note box by the note counter
472 . . . Note counter
473 . . . Manual verification
474 . . . Printer
475 . . . Print the number of stacks and the incorrect number of notes
476 . . . Take out small strips of the corresponding stacks
477 . . . Take a proper procedure
478 . . . Presence of invalid notes
479 . . . Input the number of invalid notes
480 . . . Printer
481 . . . Print the number of the invalid notes of the stacks
482 . . . Take out a small strip of a corresponding stack
483 . . . Take a proper procedure (1) The bundle is taken out and the large strip of it is numbered.

(2) The large strips are removed and stored.

(3) One of the ten bundles are taken out and its small strip is numbered. Then, the small strip is removed and put into the bundle collecting box. The note is placed on the supply section.

(4) The small strip is numbered and removed. The small strip is put into the band collecting box 53 in order. The notes is put into the supply section 1 in order.

(5) The supply section 1 pushes the notes of the first stack toward the take-out device 2.

(6) The notes are taken out from the supply section 1 sheet by sheet.

(7) The notes taken out is detected of a state of the sheet when it passes the detecting section 4 whereby the notes are sorted into superposed, false, foreign, invalid, normal and worn-out notes.

(8) The judgement of the detecting result of the notes provides a judging signal for the sheet-like material in accordance with the priority.

(9) The judging signal is shifted by the note shift circuit and the sorting direction of the sorting device is decided in accordance with the signal before the sorting devices 5 and 10.

(10) In the sorting device 5, the unidentifiable notes (other than the normal and worn-out notes) are led to the unidentifiable note collecting section 38.

(11) The normal and worn-out notes reach the sorting device 10 and those are sorted into the normal and worn-out notes in response to a shift signal as in the above case.

(12) The note passing the sorting device 10 is counted by the counter $63_1$ ($63_2$).

(13) The notes sorted as the normal notes by the sorting device 10 are counted by the counter 91 at the preceding stage of the sorting device 12 and the sorting directions of the sorting device 12, that is, the normal sheet collecting sections $11_1$ and $11_2$, is switched every 100 notes.

(14) At the entrance of the normal sheet collecting section $11_1$ ($11_2$) the number of the notes led thereto are counted by the counter 95 (96).

(15) The notes sorted as the worn-out notes by the sorting device 10 are subjected to a situation that the direction of the sorting device 14, that is, the worn-out note collecting sections $13_1$ and $13_2$, switched every stack of the notes. At the entrance of the worn-out note collecting section $13_1$ ($13_2$), the number of the notes led thereto are counted by the counter 113 (114).

(16) When none of shift miss or counting miss is confirmed at the end of the supply of one stack of notes, the contents of the counter $63_1$ ($63_2$), together with the number of the stack, are stored in the memory unit 81, through the arithmetic logic circuit 80.

(17) When the normal note collecting section to which the notes are led is switched every 100 notes and the collecting section having 100 notes collected is driven, a stack of 100 notes is transferred to the normal note stack transfer device 15 and further to the bundling device 16. When the collecting section is switched, it is stored with +1 in the memory unit 81, that is to say, the number of the normal notes thus far collected is stored.

(18) The stack which arrives at the bundling section 16 is bundled so as not to be lost in its shape, and is transferred to the stack transfer section 21 by the stack inverting device 17. The bundling check device 22 checks as to if the bundling of the stack is reliable or not.

(19) The stack judged as the reliably bundled one by the check device 22 is pushed out by the pushing device 23 and the gate 24 from the stack transfer device 21 and is laid down. The succeeding normal note stack is laid on the preceding one.

(20) The unreliably bundled note stack judged so by the check device 23 is transferred by the stack transfer device 21 to the stack reject collecting section 25.

(21) A set of two stacks superposed is transferred to the stack collecting section 27 at the stack transfer speed 26 to the stack collecting section 27 where 10 stacks are collected.

(22) A bundle of 10 normal note stacks are pushed out by the pushing device 28 to the waiting section 29. The waiting section 29 transfers the bundle to the bundle supply section 30.

(23) The bundle transferred to the bundle supply section 30 is further transferred to the bundling section 31 where it is cross-tied. The cross-tied bundle is carried out of the bundling section 31 by the transfer device 32. The bundle carried out from the bundling section is transferred to the bundle detecting section 33.

(24) The bundle is checked by the bundle detecting section 33 as to if it has 10 stacks or not. The bundle judged good is collected in the bundle collecting section 35 by the pushing device $34_1$ or $34_2$. The bundle judged bad is transferred to the bundle reject collecting section 37 by the bundle transfer device 36.

(25) When none of shift error or counting error is checked at the end of one bundle supply, the contents of the counter 113 (114), that is, the number of the present worn-out notes is added to the worn-out notes counted at the previous stage and is stored in the memory unit 81.

(26) When the worn-out note collecting section to which following one bundle supply, the next bundle is supplied, is switched, the notes are led to the worn-out note transfer device 18 is carried out to the invalidating section 19.

(27) The bundle is shredded in the invalidating section 19 and the shredded ones are into the worn-out note shreds collecting box 20.

(28) The notes which are judged as the superposed notes, the false notes, the foreign notes and the invalid notes by the detector section 4 and are led to the unidentifiable note collecting section 38 by the sorting device 5, are taken out from the collecting device 38 by an operator and counted by him. The false, foreign and invalid notes are checked again by the operator.

(29) The operator keys in the total number of the notes collected by the unidentifiable note collecting device 38 and the number of foreign, false and invalid notes by the ten key 85.

(30) When the number of notes are keyed in, a difference between the number of the normal notes and the worn-out notes counted by the counter $63_1$ ($63_2$) at this time and the set value H is taken out from the memory unit 81. The taken out one is compared by the comparator 86 with the number of the keyed in notes. The comparison checks if the number of notes is correct or not.

(31) When the correct number of the notes of the stack is keyed in with the false, foreign and invalid notes of "0", the next superposed, false, foreign and invalidation notes are taken out from the collecting device 38 and the above-mentioned operation is repeated.

(32) When the comparison shows the incorrect number of the notes, the numeral inputted is displayed by the display 90. This is visually checked by an operator. When erroneous input is made, the correct number of notes is reinputted by the ten key 85. With the keying in of the correct number of the notes, the printer 55 prints the number of the stack, the number of the erroneous inputtings, and the number of the reinputtings. The key input device which has been locked due to erroneous inputting is released. The processing of the next stack is performed.

(33) When there is the incorrect number of notes but no erroneous input and when there is the incorrect number of the notes though the reinputting is made, the key input device is locked. The locking state may be unlocked by using only the key of a supervisor. When the key input device 54 is locked, the supervisor takes out the small strip corresponding to the stack having an incorrect number of notes on the bases of the number displayed on the display 87. When the lock is released, he receives the number of the stack and the total number of the stacks, which are printed by the printer 55.

(34) When the ten key 85 inputs the false, foreign and invalid notes with numeral other than "0", the key input device is also locked, as in the previous case. Also in this case, an operator transfers the false, foreign and invalid notes, and the corresponding small strip to a supervisor for unlocking the key input device. After unlocking, the number of the false notes, foreign notes and invalidating notes and the number of the stack including them are printed out by the printer 55.

(35) The number of the notes keyed in is stored in the memory unit 81. Before the number of the next notes in inputted, it is stored with addition of the total number of the notes collected in the unidentifiable note collecting section 38 and the total number of the foreign, false and invalid notes.

(36) When jam takes place in the sorting device or the collecting section or shift error occurs in the sorting device, the jam detecting circuit detects it to stop the transfer of the notes. By checking the display of a location of the jam, the notes at the location is adjusted or picked out and then all the notes on the transfer path are collected. At this time, the take-out device 2 is in stop condition.

(37) An incorrect number of notes, a undesirable result of the verification or a shift error stops the take-out of the notes and collects the notes on the transfer path in the collecting section.

(38) After the steps (36) and (37), all the notes are taken out from the respective collecting sections and collected in the take-back box 39.

(39) After the process of (38), the note supply starts again. After the sorting of one stack, the number of the notes after the end of the (32) process is counted by the counter $63_1$ ($63_2$) and the above-mentioned operation is performed. The result of the operation, together with an abnormal code, is stored in the memory unit 81.

(40) To count and verify the notes of the stack in step (39) in the unidentifiable note collecting device 38, as in the case of no jam, incorrect number of the notes, or shift error, the notes are taken out from the unidentifiable note collecting device 38 the total number of the notes, the numbers of the false, foreign and invalid notes are keyed in, so that the key input device is locked. Then, the number of the notes in the take-back box 39 is counted by an ordinary counter and is keyed in by the ten key 85. After this operation, if the apparatus provides the judgement of the correct number of the notes, the lock of the key input device is released. At this time, the printer 55 prints the number of the notes within the take-back note box 39.

(41) When the incorrect number of the notes is found in the step (33), a similar process is performed.

(42) Of the large and small strips of the bundles after the verifications thereof are completed, those having the incorrect number of the notes, and the false, foreign and invalid notes are discarded.

(43) After the verifications by using the sorting operation and the key input device 54 are completed, the printer 55 prints the sum of the total number of the notes in the unidentifiable note collecting device 38, and the numbers of the false, foreign and invalid notes. Seeing this, an operator may check again the number of these notes.

(44) After the sorting operation and the verification by using the key input device 54 are completed, the printer 55 prints out the total number of the worn-out notes and the total number of the normal notes. The total number of the worn-out notes may be reached by the total number of the normal notes and the total number of the notes in the unidentifiable note collecting section 38.

What we claim is:

1. A sheet sorting apparatus comprising:

take-out means or taking out sheets one at a time from a stack having a given number of sheets;

conveying means for conveying the sheets taken out by the take-out means;

detecting means for classifying the sheets conveyed by the conveying means into reusable sheets and unreusable sheets;

sorting means for sorting the sheets classified by the detecting means into reusable and unreusable sheets, said sorting means further including a counter means for counting at a plurality of points the number of sheets judged as unreusable by said detecting means;

collecting means for separately collecting the reusable sheets and the unreusable sheets which are sorted by the sorting means until the given number of sheets has been taken out; and invalidating means for invalidating the unreusable sheets collected in the collecting means after the take-out of the given number of sheets is completed, and when the counts in said counter means are not coincident, said invalidating means does not invalidate said sheets.

2. A sheet sorting apparatus comprising:

take-out means for taking out sheets one at a time from a stack having a given number of sheets;

conveying means for conveying the sheets taken out by the take-out means;

detecting means for classifying the sheets transferred by said conveying means into normal, worn-out and unidentifiable sheets;

recording means for recording the number of normal sheets and the number of worn-out sheets classified by said detecting means from said given number of sheets;

first collecting means for collecting the sheets classified as unidentifiable by said detecting means;

second collecting means for collecting the sheets classified as worn-out by said detecting means until the take-out of the given number of sheets is completed;

third collecting means for collecting the sheets classified as normal by said detecting means;

invalidating means for invalidating the sheets collected in said second collecting means after said given number of sheets has been taken-out;

input means for inputing the number of sheets collected in said first collecting means;

comparing means for determining whether the given number corresponds to the sum of the number of sheets inputted on said input means and the number recorded by said recording means;

bundling means for creating bundles of sheets collected in said third collecting means, each having a second given number of sheets;

transfer means for transferring the sheets bundled by said bundling means;

stack collecting means for collecting the sheets transferred by said transfer means; and stack bundling means for bundling the stacks of sheets collected in said stack collecting means.

3. A sheet sorting apparatus comprising:

take-out means for taking out sheets one at a time from a stack having a first given number of sheets;

conveying means for conveying the sheets taken out by the take-out means;

detecting means for sorting the sheets into reusable and unreusable sheets;

first collecting means for collecting a second give number of sheets sorted as reusable by said detecting means;

bundling means for bundling each second given number of sheets collected in said first collecting means;

transfer means for transferring the bundled reusable sheets;

stack collecting means for collecting the sheets transferred by said transfer means;

stack bundling means for bundling the stacks of sheets collected in said stack collecting means;

second collecting means for collecting sheets sorted as unreusable by said detecting means until said first given-number of sheets are taken-out;

invalidating means for invalidating the sheets collected in said second collecting means after said first given-number of sheets are taken-out;

recording means for counting the number of unreusable sheets sorted by said detecting means before the sheets are invalidated by said invalidating means, and recording the number of sheets; and display means for displaying the number of sheets bundled in said bundling means and the number recorded in said recording means.

4. A sheet sorting apparatus according to claim 2 or 3 in which said stack bundling means ties the bundle by a strip in a crossing manner.

5. A sheet sorting apparatus according to claim 2 or 3, further comprising check means for checking whether a predetermined number of stacks have been bundled after the stacks of sheets are bundled.

6. A sheet sorting apparatus according to claim 2 or 3, further comprising:

transfer means for transferring the bundled stacks of sheets;

check means provided in the midportion of said transfer means for checking whether a pedetermined number of stacks have been bundled; pushing means for pushing the bundled stacks; and collecting means for collecting on an extension of said transfer means those bundles which do not have said predetermined number of stacks.

* * * * *